United States Patent [19]

Muse et al.

[11] Patent Number: 4,531,582

[45] Date of Patent: Jul. 30, 1985

[54] WELL CONDUIT CENTRALIZER

[75] Inventors: John F. Muse; Harry W. Riddle; Frank S. Zeiler; Juventino Buruato, all of San Antonio, Tex.

[73] Assignee: Baker Oil Tools, Inc., Orange, Calif.

[21] Appl. No.: 547,408

[22] Filed: Oct. 31, 1983

[51] Int. Cl.[3] ..... E21B 17/10

[52] U.S. Cl. ..... 166/241; 166/172; 308/4 A

[58] Field of Search ..... 166/241, 172, 173; 308/4 A

[56] References Cited

U.S. PATENT DOCUMENTS 2,251,428 12/1939 Smith ..... 308/4 A 2,897,016 7/1959 Baker ..... 308/4 A 3,566,965 3/1971 Solum ..... 166/241

*Primary Examiner*—Stephen J. Novosad

*Assistant Examiner*—Michael Goodwin

*Attorney, Agent, or Firm*—Norvell & Associates

[57] ABSTRACT

A conduit centralizer comprises segmented, sliding means connected by a plurality of axially extending, outwardly bowed leaf springs. Each sliding means is formed by the hinged connection of a plurality of double walled segments. The ends of the leaf springs are respectively inserted within the double walled segments and welded to both the inner and outer walls of the segments, thus providing an extremely rigid structure which is fabricated without machining operations.

5 Claims, 8 Drawing Figures

WELL CONDUIT CENTRALIZER

BACKGROUND OF THE INVENTION

1. Field of the Invention

The invention relates to a centralizing device for maintaining a well conduit in a central position with respect to a well bore.

2. Description of the Prior Art

Conduit centralizers, such as casing centralizers, have been employed for almost as long as well casings have been inserted in well bores. The centralizer commonly comprises two axially spaced pairs of ring members which are generally formed from at least two hingedly interconnecting segments to permit the rings to be positioned on the casing in snug but slidable relationship thereto. The axially spaced rings are rigidly connected to opposite ends of outwardly bowed portions of the leaf spring members spaced around the periphery of the rings. The outwardly bowed portions of the leaf springs are proportioned to engage the well bore and to be compressed inwardly by such engagement, thus exerting a centralizing force on the casing to which the centralizer is applied. Normally the centralizer is moved into the well with the casing by a clamping ring which is mounted securely to the exterior of the casing at a position between the two spring connected slidable rings.

Because of the ever increasing depths of modern wells, requiring a large number of casing centralizers to be employed for each well, there has been great emphasis in the well tool industry to minimize the cost of centralizers without in any manner reducing their effectiveness. It has previously been proposed, for example in U.S. Pat. No. 4,088,186 to Callihan et al, to fabricate the pivotally interconnected slidable rings from stampings to minimize the manufacturing costs thereof. The stamping procedure necessarily means that the hinge elements on ends of the segment components of each slidable ring are formed by bending operations on projecting tabs which are well known to produce a wide variation in dimensions of the resulting hinges. Moreover, the application of forces to the hinges can result in a springing of the hinge ends which are not supported or secured in any manner other than the interengagement of the hinges by the hinge pin. It is important that the sliding rings, when assembled, have an internal diameter closely approaching that of a true cylinder, and an internal diameter exceeding the diameter of the casing to which it is to be assembled by only a few thousandths of an inch so that a snug sliding fit of the slidable rings on the casing is achieved. This has not been possible with the stamped components heretofore utilized in the art.

SUMMARY OF THE INVENTION

Preferably, the invention provides a conduit centralizer wherein each of the axially spaced sliding rings which are secured together by the outwardly bowed leaf springs are fabricated by the pivotal assemblage of a plurality of double walled arcuate segments. Each segment is formed by stamping operations on a generally rectangular sheet of metal which is double folded to bring the short ends of the rectangular piece into parallel adjacent relationship and thus define two closed loop ends. Prior to the folding operations, a plurality of spaced apertures are formed in the sheet metal piece which traverse the loop areas of the folded piece so as to define spaced hinges.

As an important feature of this invention, the ends of the bowed leaf spring members are then inserted between the double walled segments and secured thereto by, typically, at least two spot welds, with each weld connecting one of the adjacent ends of the double walled member to the end of the leaf spring. It is thus assured that each double walled stamped segment is a completely rigid piece, and particularly the hinge elements defined by the folded portions of the double walled member are not susceptible to stretching or deformation through the application of forces thereto during the assemblage of the resulting sliding ring to a casing or insertion of the centralizer in the well bore.

To further improve the operating efficiency of the casing centralizer embodying this invention, each of the internal walls of the double walled segment is provided with a radially outwardly directed flange which is normally positioned a short distance inwardly from an adjacent leaf spring element. Thus, the initial inward deflection of the outwardly bowed leaf spring elements occurs across the entire length of the leaf spring, but after such initial inward deflection, the leaf spring element contacts the radially projecting flanges provided on the double walled segments and this contact effectively shortens the length of each leaf spring member, thus greatly increasing the stiffness of the leaf spring member to further inward deflection. This permits the easy insertion of the outwardly bowed leaf spring in the well bore, followed by an increased frictional engagement of the leaf spring elements with the well bore as complete insertion is accomplished.

Lastly, each of the double walled stamped segments may be provided with a tab in the vicinity of the folded hinge portions which may be bent to overly an inserted hinge pin and prevent its removal after assemblage of the hingedly interconnected segments to a length of casing.

A further feature of this invention is the employment of a sizing mandrel to insure that the assembled casing centralizer will snugly but slidable mount on a length of casing. The casing centralizer is assembled around an expandable mandrel and initially defines an internal diameter slightly less than that desired for the final diameter of the slidable segmented rings. The segmented rings are then expanded to a true cylindrical configuration of the precise dimensions desired through expansion of the expandable mandrel.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
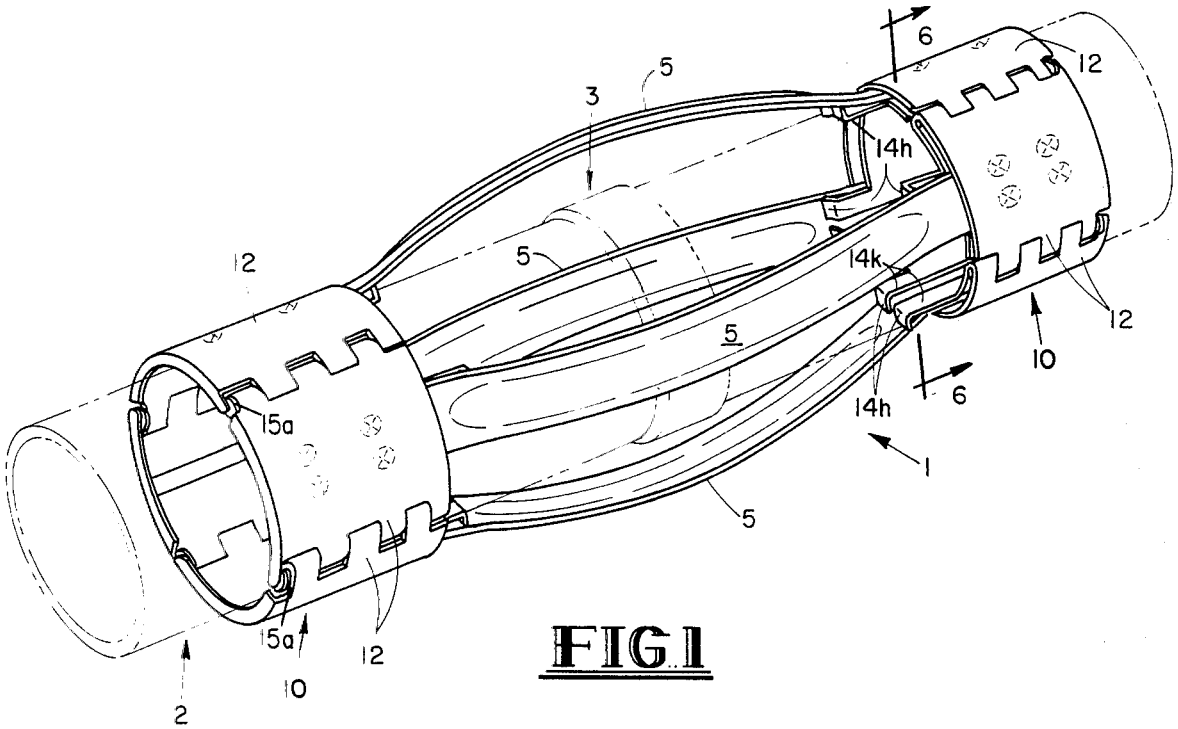
FIG. 1 is a perspective view of a casing centralizer embodying this invention shown in assembled relationship to a length of casing carrying a stop ring for moving the centralizer with the casing.

Referring to FIG. 1, a casing centralizer assemblage 1 embodying this invention comprises two identical, slidable ring elements 10 which are interconnected by a plurality of peripherally spaced, outwardly bowed leaf spring elements 5. Ring elements 10 are snugly, but slidably, mounted on a length of casing 2. A conventional stop ring 3 is clamped to the casing 2 between the slidable rings 10.

Figure 2:
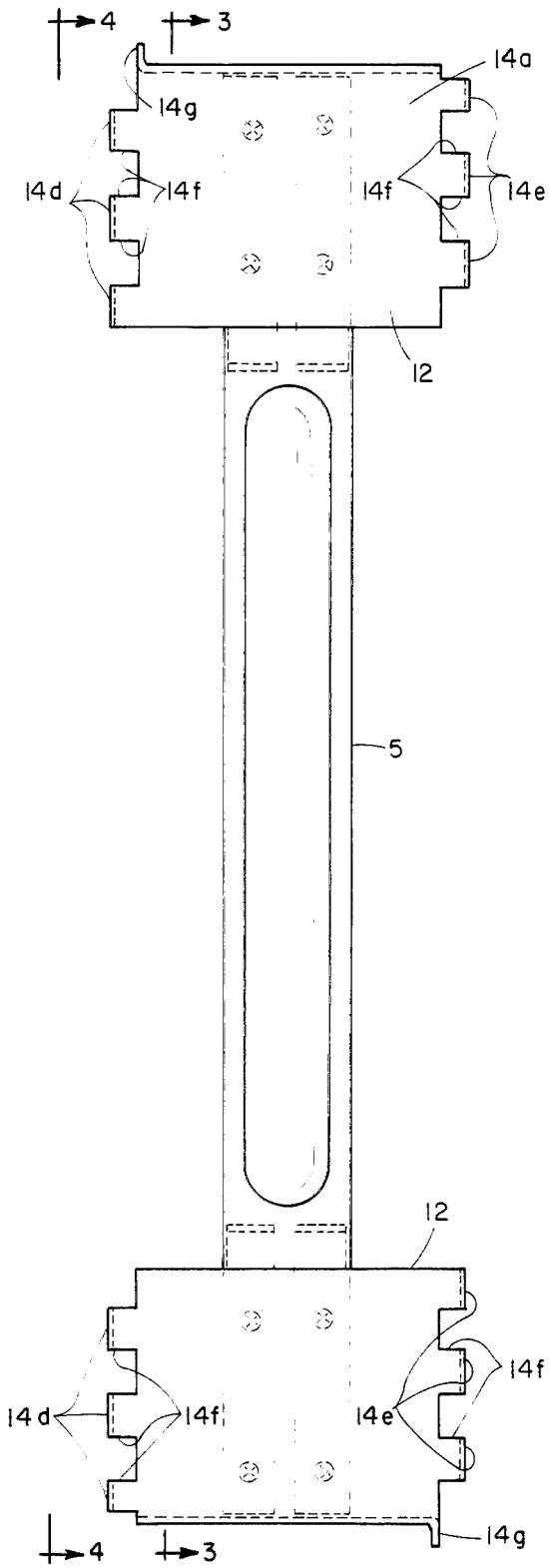
FIG. 2 is a side elevational view of a single segment of the casing centralizer of FIG. 1.
Figure 3:
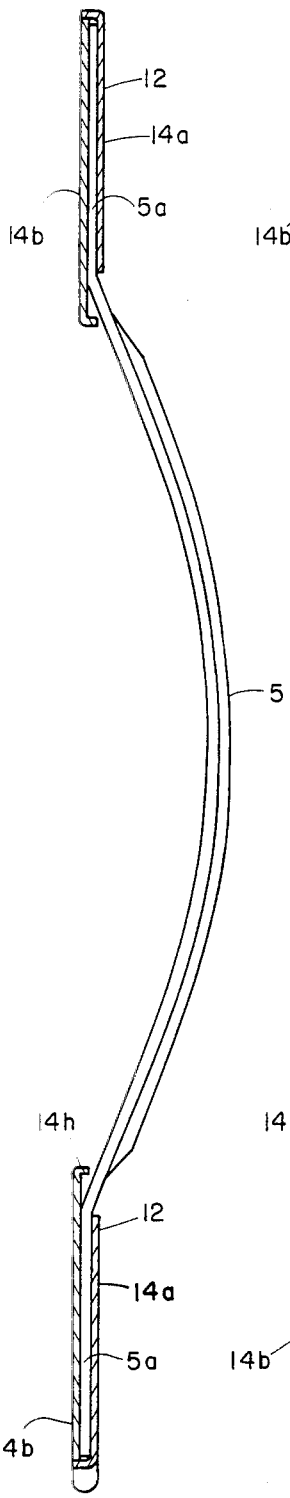
FIG. 3 is a sectional view of FIG. 2 showing the leaf spring element of the casing centralizer in an unstressed condition.
Figure 6:
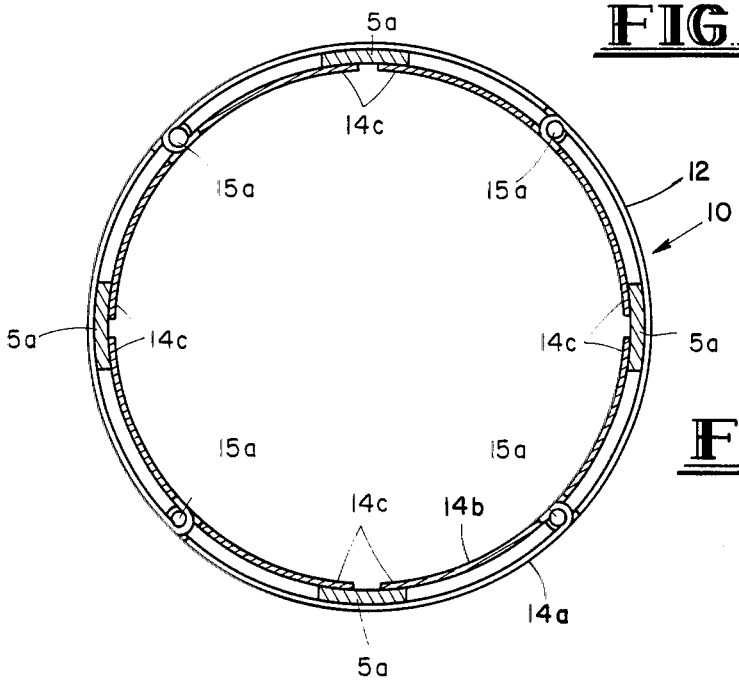
FIG. 6 is a sectional view taken on the plane 5—5 of FIG. 1.
Figure 8:
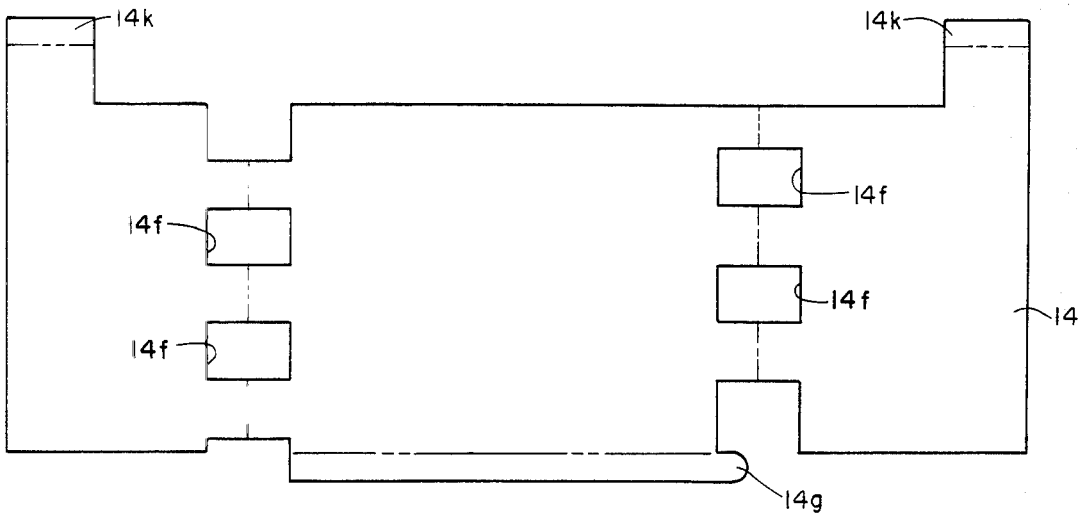
FIG. 8 is a plan view of the blank from which each double walled segment is formed.

Each slidable ring element 10 comprises a pivotally interconnected assemblage of a plurality of double walled segments 12. As best shown in FIGS. 2, 3, and 6, each segment 12 is fabricated by conventional stamping and bending operations on a generally rectangular blank 14 of ferrous metal (FIG. 8). Thus the blank 14 is double folded around a 180° arc to define an outer wall 14*a* and an inner wall 14*b* formed by positioning the two short edges 14*c* of the rectangular blank 14 in parallel, adjacent relationship. The cross sectional configuration of the double walled unit 12 is that of an arcuate segment, and enough of such units are hingedly interconnected to provide the desired size of casing centralizer so that the internal diameter defined by the assembled segments slightly exceeds that of the casing 2 on which it is to be snugly but slidably assembled.

The sheet metal blank 14 is further provided with a plurality of vertically spaced apertures 14*f* positioned to overlie each folded area of each blank 14 when folded to form the double walled configuration. The apertures 14*f* define a plurality of vertically spaced hinges 14*e* along one side of each double walled segment 14, and 14*d* along the opposite side. Hinges 14*d* and 14*e* are respectively vertically staggered with respect to each other so that they may be assembled in cooperative relationship with an adjoining double walled segment 12. Thus, the hinges 14*d* on any one double walled segment 12 interengage with the hinges 14*e* on the adjacent segment, and such segments may be securely fastened together by dropping a hinge pin 15 through the aligned openings defined by the interengaged hinges 14*d* and 14*e*. A substantially continuous outer cylindrical surface is thus formed.

Figure 4:
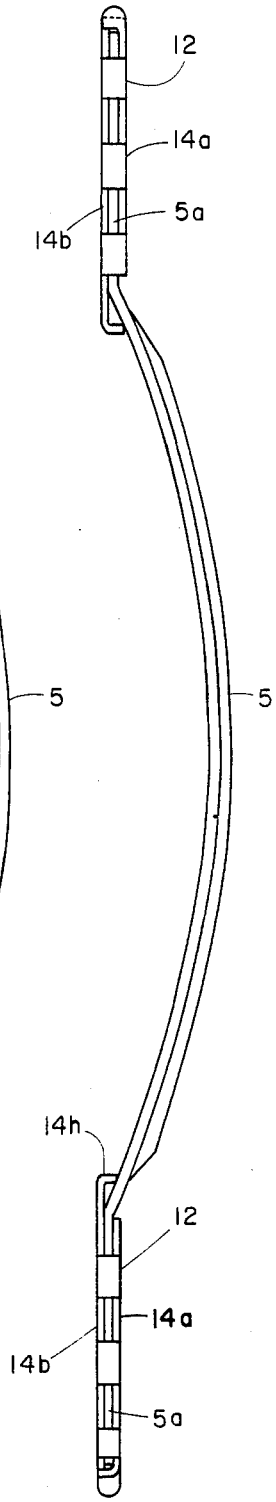
FIG. 4 is an elevational view illustrating the position of the leaf spring element in a stressed position when the centralizer is inserted in a well bore.
Figure 5:
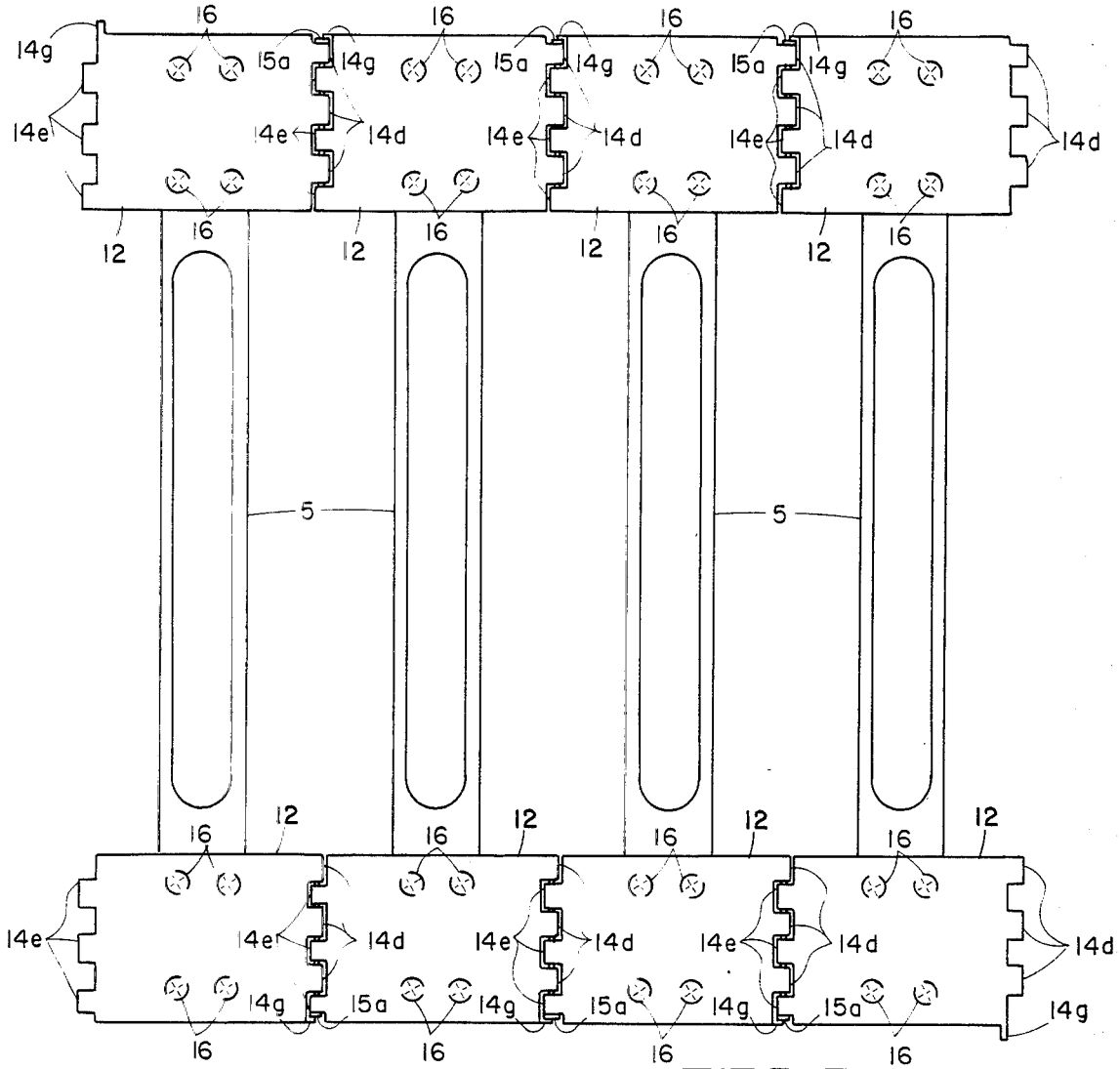
FIG. 5 is an elevational view of a plurality of individual segments of the type shown in FIG. 2 shown in partially assembled relationship prior to wrapping same around a length of casing.

A projecting tab 14*g* is provided on each of the double walled segments 14 in a position to be folded into overlying engagement with the head portion 15*a* of the inserted hinge pin 15. In FIG. 4, the end double walled segment 112 has not yet been assembled to another segment, and hence the retaining tab 14*g* is shown in its original position. When assembly of the two end segments 14 is accomplished by dropping a hinge pin 15 through their respective aligned hinge elements 14*d* and 14*e*, the tab 14*g* shown in FIG. 2 will be bent over to assume the same configuration as the other tabs illustrated therein.

An outwardly bowed leaf spring element 5 is connected at each end to a double walled arcuate segment 12 to thus interconnect the upper ring 10 of such segments to an identical lower ring of such segments. The end portions 5*a* of the outwardly bowed leaf springs 5 are contoured to fit snugly between the walls of the particular double walled segments 12 to which it is connected. Such end portions 5*a* are welded to both the inner walls 14*b* and the outer walls 14*a* of the respective double walled segment 14. A minimum of two welds is employed so that each of the free ends 14*c* of the inner wall 14*b* will be welded to the respective spring end 5*a* and thus each segment 12 will be securely held in its double walled configuration. As illustrated in FIG. 1, four pressure type spot welds 16 are preferably employed with two of the welds securing each of the free edges 14*c* of the double walled segment 14 to the spring end 5*a* and in turn securing the outer wall 14*a* to such spring end 5*a* at four points.

As best shown in FIG. 3, the inner wall 14*b* is provided with radially outwardly projecting integral flanges 14*h*. In the unstressed position of the leaf spring 5 (FIG. 3), there is a space between the end of the flanges 14*h* and the respective leaf spring 5. However, as illustrated in FIG. 4, when the leaf spring 5 moves into abutting engagement with the flanges 14*h*, this, in effect, shortens the length of each outwardly bowed spring element 5 and changes its spring constant, making the spring stiffer and more difficult to deflect inwardly. As previously mentioned, this feature permits the easy insertion of each casing centralizer into the well bore but once it is partially inserted, the frictional resistance of the outwardly bowed leaf springs 5 increases as it is fully inserted into the well bore. The radially out-turned flanges 14*h* serve an additional function in that they provide an abutment surface for the respective slidable ring 10 which is engaged by the stop ring 3 which is fixedly secured to the casing 2 in a position intermediate the two segmented slidable rings 10. Thus, limited movement of the casing 2 relative to the slidable rings 10 is permitted until the stop ring 3 strikes the abutment flanges 14*b*, whereupon the centralizer 1 is moved with the casing 2.

It is preferred to design the segmented, double walled, slidable rings 10 so that the internal diameters thereof are slightly less than the external diameter of the casing on which the centralizer is to be mounted. This permits the expansion of the internal diameter of the segmented, slidable rings 10 to exactly conform to a cylinder having the desired diametrical clearance with respect to the casing 2 on which it is to be assembled.

Figure 7:
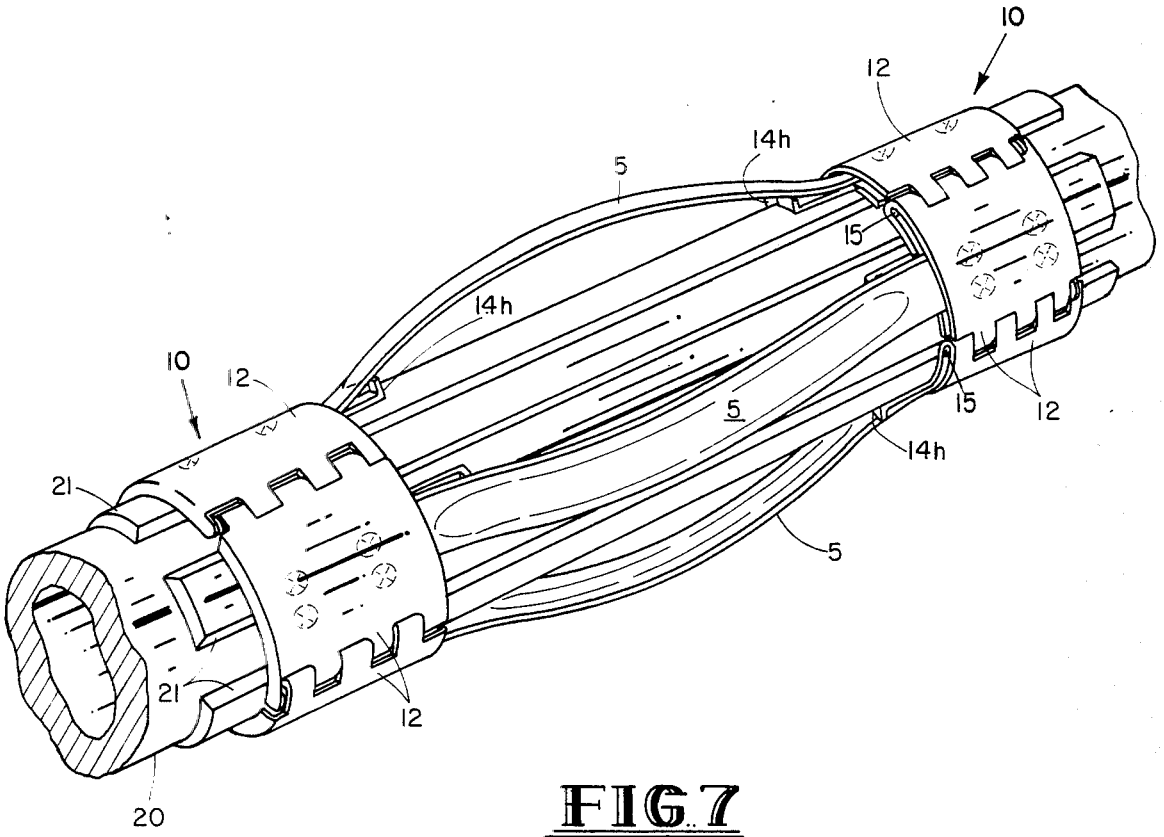
FIG. 7 is a schematic, perspective view illustrating the sizing of the segmented slidable rings of the casing centralizer by an expandable mandre.

As illustrated in FIG. 7, a conventional expandable mandrel 20 is concurrently inserted through both the upper and lower sliding rings 10 of the casing centralizer. Expandable mandrel 20 has conventional expanding elements 21 (shown only schematically) which can be actuated to more radially outwardly and thus concurrently expand the internal diameter of both the upper and lower segmented rings to exactly conform to a cylindrical shape of the desired diameter to insure a snug, slidable fit with the casing.

Those skilled in the art will recognize that the aforedescribed construction provides a centralizer of unusual rigidity and accuracy, yet utilizing a minimum of metal and is fabricated with no expensive machining operations. Moreover, the assembly of the unit in the field is accomplished with simple tools and the assembly operation can in no manner disturb the accuracy of the diametrical dimensions of the sliding rings of the centralizer.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A well conduit centralizer, comprising a pair of hingedly connected segmented means mountable in axially spaced slidable relation on a length of conduit; each segment of each segmented means being rigidly secured to an end of an outwardly bowed leaf spring; each said segment initially comprising a unitary rectangular sheet having a length dimension greater than its width and two parallel width edges which is deformed by double folding and stamping into an arcuate double walled segment with one of said walls having said parallel width edges disposed in axially parallel, adjacent relationship to separate said one wall into two portions, said double walled segment having apertures spaced along each fold area, thereby defining spaced hinge elements for pivotal connection to the hinge elements of an adjacent segment by hinge means; said leaf spring ends being respectively inserted within axially spaced double walled segments and secured to both walls of each double walled segment by welding both portions of said one wall and the other wall to said inserted leaf spring end.

2. The well conduit centralizer of claim 1 wherein said one wall of said double walled segments is disposed on the radially inner side of said segments, whereby the outer peripheral face of said interconnected end segments is a substantially continuous cylindrical surface.

3. The well conduit centralizer of claim 1 further comprising a tab formed on a length edge of each said rectangular stamping adjacent one set of said apertures, said tab being constructed and arranged to be bent in overlying relationship to a hinging member of said hinge means inserted in the hinge means defined by the adjacent apertures.

4. The well conduit centralizer of claim 1 wherein the segmented means are axially traversed by an expandable mandrel and expanded to a desired internal circumference.

5. The well conduit centralizer of claim 1 wherein a radially outwardly projecting flange is formed on at least one of said adjacent width edges of each said double walled segments; said flanges extending axially and radially outwardly to be respectively engaged by said leaf springs upon inward deflection of said outwardly bowed portions of said leaf springs, thereby changing the spring constant of said leaf springs after a predetermined inward deflection to increase the stiffness of said leaf springs.

* * * * *